United States Patent [19]

Heinemeyer et al.

[11] Patent Number: 4,730,236

[45] Date of Patent: Mar. 8, 1988

[54] PROCESS FOR ENCAPSULATING A SENSITIVE COMPONENT IN A PROTECTIVE HOUSING AND ARTICLE

[75] Inventors: Friedrich Heinemeyer, Siegburg; Gert Kamp; Winfried Nass, both of Troisdorf; Frank Runge-Eschen; Gottfried Senkowski, both of Troisdorf; Joachim Sturm, Lohmar, all of Fed. Rep. of Germany

[73] Assignee: Dynamit Nobel Aktiengesellschaft, Fed. Rep. of Germany

[21] Appl. No.: 898,598

[22] Filed: Aug. 21, 1986

[30] Foreign Application Priority Data

Aug. 21, 1985 [DE] Fed. Rep. of Germany ..... 3529884

[51] Int. Cl.[4] ..... H05K 7/00

[52] U.S. Cl. ..... 361/392; 174/52 PE; 174/52 S; 361/417; 361/419

[58] Field of Search ..... 361/392, 417, 419; 174/52 PE, 52 R, 52 S, DIG. 8; 219/388 R, 209, 385, 386

[56] References Cited

FOREIGN PATENT DOCUMENTS 978357 12/1964 United Kingdom ..... 174/52 PE

*Primary Examiner*—A. D. Pellinen
*Assistant Examiner*—Morris Ginsburg
*Attorney, Agent, or Firm*—Antonelli, Terry & Wands

[57] ABSTRACT

In order to avoid embedding a sensitive component in a resinous potting material, as usual, a prefabricated protective housing is used which includes a prefabricated housing body in which the sensitive component is inserted, initially with a clearance at one end of the component. A deformation zone of the housing body is plastically deformed in order to fix the component in place in an axial direction by clamping. Then an elastically deformable lid is attached to the housing body, this lid maintaining the component radially in contact against a seat. The protective housing is especially suited for use in devices which contain explosives because no dangerous working materials are utilized during the encapsulation or encasement process and, consequently, there is no exudation of aggressive resin ingredients.

10 Claims, 3 Drawing Figures

PROCESS FOR ENCAPSULATING A SENSITIVE COMPONENT IN A PROTECTIVE HOUSING AND ARTICLE

BACKGROUND OF THE INVENTION

This invention relates to a process for the encapsulation or encasement of a sensitive component in a protective housing made of a synthetic resin, with a force-locking fixation of the component within the protective housing and to the assembly protective body and the sensitive component.

Electrochemical and electronic structural elements must be installed in devices exposed to extreme mechanical stresses (vibration, shock) during shipping, storage, or operation in such a way that the aforementioned stresses do not result in damage to these structural elements with ensuing uselessness of the primary device. This holds true to a special extent for ammunition. A process, presently finding general acceptance, for avoiding vibration- or shock-induced damages to the structural elements makes use of the properties of certain curable synthetic resins which are fluid prior to a curing step (during the "pot life") and, after curing, exhibit the desired mechanical properties (high strength and toughness, and high shock-absorbing capacity by plastic deformability).

This arrangement is based on the premise that the components to be installed must be cast together with the structure of the device to form a unitary, solid body to attain the desired properties.

The required mechanical characteristics are usually obtained by synthetic resin systems, e.g., multi-component epoxy resins, in part with the addition of shock-absorbing extenders, such as, for example, hollow glass microspheres. The required mixture ratio of the reactive ingredients must be maintained within narrow limits to avoid the possibility of incompletely reacted mixtures; such mixtures, on the one hand, do not attain the desired values of the mechanical properties and, on the other hand, are capable of releasing chemical compounds deleterious to the other substances and materials present, and also, in case of ammunition, to explosive compounds. A considerable array of expensive tests must be carried out to ensure the correct mixture ratio. The operating units for the processing and metering of the reactive components are technically expensive and require intensive servicing.

The aforementioned synthetic resin systems reach the desired values for their properties only during the course of the curing reaction which takes typically several hours at an elevated temperature. For this reason, temperature-controlled chambers are required for the processing of such synthetic resin systems, wherein the case or molded appliances must be stored during the curing reaction. This necessity increases technical expenditure and represents a stage where manufacturing capacity is reduced.

The reactive components of the synthetic resin systems must be considered to be dangerous working materials, the use of which places considerable demands on the monitoring of the respective working places with regard to working hygiene and safety procedures.

In the process of protecting components against shock- or vibration-induced damage with the use of potting materials according to the state of the art, the necessary electrical connections (wires, stranded conductors, flexible printed wiring conductors) are, in the normal case, likewise enclosed flush with molded appliance. If the cured element is, for example, subjected to stress by a shock, surpassing the prevailing cohesion forces, then the potting material will be torn open and, as experience has shown, the same will happen to the encompassed electrical connections—especially flexible printed wiring conductors. In this way, losses of function can arise even though there is no damage to the active and passive electronic components to be protected.

SUMMARY OF THE INVENTION

This invention is based on the object of providing a process of the type heretofore described which can be performed without the use of potting materials such as epoxy resins, which can be conducted with low expenditure, and which offers effective protection of the sensitive component, e.g., electronic component, against shock and vibrations.

This object has been attained according to the invention by providing that, after insertion of the sensitive component in a seat of a prefabricated housing body, at least one deformation zone of the housing body is plastically deformed in parallel to the seat in such a way that the component is firmly clamped within the housing body, and that the housing body is sealed by means of an elastically deformable lid which presses against the component and urges the component against the seat.

In the process of this invention, a three-dimensional, force-locking or pressure-generating fixation of the component in the housing body takes place in two steps, wherein dimensional tolerances of the protective housing and the sensitive component are compensated for by elastic and/or plastic deformation of the protective housing. In this arrangement, the expensive technical devices, required according to the state of the art, for the preparation, mixing, and metering of reactive synthetic resins, as well as the curing of the resins, are not required. The housing body as well as optionally the lid encompassing the same are prefabricated parts that can be produced separately by means of the usual techniques, for example, by injecting molding, and are already full hardened when the encapsulating or embedding process is carried out. Therefore, there is no danger of damage to the encapsulated component or additional parts of the primary device by aggressive resin ingredients. The sensitive component is firmly pressed against the seat by the lid which is elastically deformed during this step, and the component is thereby fixed or retained in place in the housing body in a form fitting fashion. Preferably, the lid is subsequently joined to the housing body by a welding or an adhesive bond. The process of this invention is thus particularly suitable for components containing explosive material or for components which are inserted together with the protective housing in a device that contains an explosive, such as, for example, mines or other ammunition.

When using the protective housing for installation of devices with an explosive, or in devices that contain explosives, the synthetic resin of the protective housing must be compatible with the explosive employed. Especially suitable materials for the protective housing are acrylonitrile-butadiene-styrene copolymers (ABS), polyamides (PA), polycarbonates (PC), with or without fiber reinforcement.

A special advantage of the invention resides in that it is unnecessary to fix all of the elements of the encapsulated component within the protective housing. Rather, it is sufficient to affix the parts having a large mass (e.g., battery, activator, or the like) in the described fashion while parts having a small mass (e.g., cables, flexible printed circuits, and the like) can be "floatingly" installed in one or several cavities of the housing. Thereby, components of a small mass can freely move within the protective housing, within limits, so that the danger of tearing of electrical connections under impact or vibration stress is reduced.

The component encapsulated in the protective housing according to the process of this invention can involve an electrically functioning module, such as, for example, the activator or detonator of a mine. Preferably, the protective housing serves for acoommodating electrical components inserted in a device containing explosives, for example, in a mine or some other article of ammunition.

BRIEF DESCRIPTION OF THE DRAWINGS

The embodiments of the invention will be described in greater detail below with reference to the accompanying drawings wherein.

DETAILED DESCRIPTION OF THE INVENTION

Figure 1:
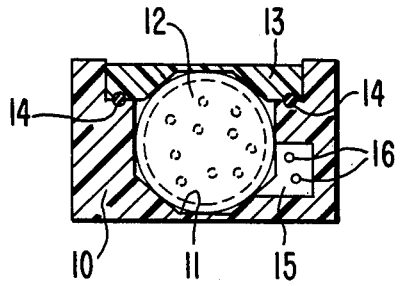
FIG. 1 shows a cross-section through the finished protective housing.

The protective housing as shown in FIG. 1 includes a trough-shaped housing body 10 consisting of a synthetic resin, e.g., an ABS resin, and prefabricated, for example, by injection molding. The housing body 10, open only on its topside, includes an indentation or cavity forming a seat 11 for a sensitive component 12, e.g., mine activator, to be encapsulated or encased. The opening at the topside of the housing body 10 is closed by the lid 13 also formed of the synthetic resin. In this procedure, the lid 13 is pressed while under the effect of ultrasound onto the housing body 10 and the component 12, with weld seams 14 (i.e., seams of fused resin) being produced between the lid 13 and the housing body 10. The lid 13 is elastic and urges the component 12 radially firmly against the indentation-like seat 11 so that radial play between the component 12 and the protective housing is no longer possible. The indentation-like seat 11 in the illustrated embodiment has a polygonal configuration. It is not necessary for the component 12 to be in contact with the seat 11 with its entire surface in order to obtain the required fixation. The only important aspect is that the cross section of the cavity receiving the component 12 will diminish toward the end facing away from the lid 13.

The housing body 10 according to FIG. 1 exhibits, laterally of the cavity housing or containing the component 12, another cavity 15 wherein smaller components 16, e.g., cables, flexible printed circuits, and the like, are accommodated. The components 16, which have a small mass, are not fixed in place in the cavity 15, and are arranged so that they can freely move therein.

Figure 2:
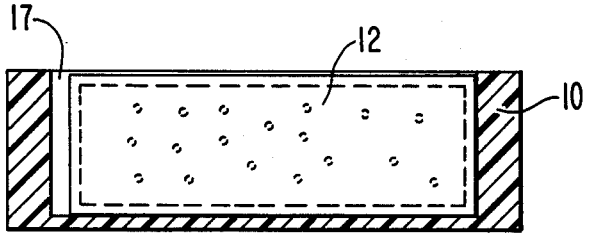
FIG. 2 a longitudinal sectional view of the housing body with the component having been inserted, prior to deformation of the deformation zone.
Figure 3:
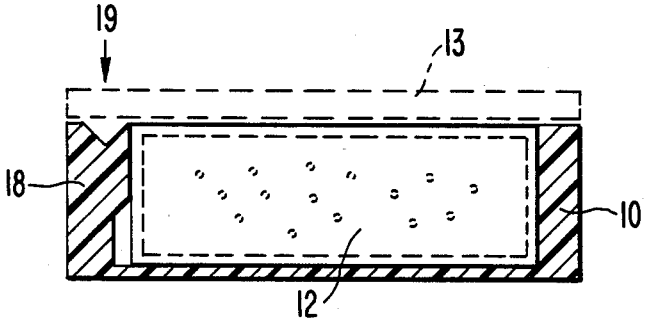
FIG. 3 shows an illustration similar to FIG. 2 after deformation of the deformation zone has been performed.

FIG. 2 shows the housing body 10 directly after insertion of component 12. The length of the cavity for accommodating component 12 is somewhat larger than the length of the component, so that a gap 17 is produced between an end wall of the housing body and the associated end wall of component 12. The end wall of the housing body constitutes a deformation zone 18 of the housing (FIG. 3) which, after insertion of component 12, is deformed by application of a force shown by arrow 19 to cause plastic deformation in the axial direction of the housing during the first step of the process. In this manner the wall yields in the transverse direction and presses axially against the end wall of component 12. Component 12 is thus fixedly clamped between the two end walls of the housing body 10 so that axial play in the cavity forming the seat 11 is not longer possible. Thereafter, the lid 13 can be welded in place to then seal the opening of the housing body 10; as a result, radial play between the component and the protective housing is no longer possible.

Preferably during the application of the force 19 also heat or ultrasound are applied. Of course it would be also possible in case of application of heat to plasticize the resin shortly before the force is applied. The amount of heat or ultrasound is to be adjusted to the plasticizing temperature of the resin used.

It will be appreciated that the plasticizing of the resin is restricted to specific areas, i.e. the seams 14. This is achieved by, for example, providing the lid 13 with ribs on the lower surface which come into contact with the corresponding surface of the housing body 10 so that they will get plasticized under application of ultrasound and force. In case of application of heat these ribs can be plasticized by using a heat knife by orientated (Gezielter) infra red radiation or laser welding. The heat and/or the ultrasound are selected so that damage of the component 12 is avoided.

What is claimed is:

1. A process for encapsulating a sensitive component in a protective housing body formed of a synthetic resin, with a force-locking fixation of the component in the protective housing, which comprises inserting the component in a seat of a prefabricated housing body through an opening in said housing body, plastically deforming at least one deformation zone of the housing body in parallel to the seat in such a way that the deformation zone contacts the component and the component is firmly clamped within the housing body, and sealing the opening in said housing body with an elastically deformable lid which presses against the component and urges the component against the seat.

2. A process according to claim 1, wherein the lid is joined to the housing body by welding.

3. A process according to claim 1, wherein the lid is joined to the housing body by an adhesive.

4. A process according to claim 1, wherein the deformation of the deformation zone takes place by exertion of a force perpendicularly to the direction in which the component is clamped by wall portions of the housing.

5. A process according to claim 1, wherein the deformation of the deformation zone takes place under the action of heat or ultrasound.

6. A process according to claim 1, wherein said at least one deformation zone is located in an end wall of the housing body adjacent to said seat and said end wall is plastically deformed to come in contact with a portion of said sensitive component.

7. An assembly of a protective housing and a sensitive component, which comprises a member formed of a synthetic resin surrounding the sensitive component under force-locking fixation, said member comprising a housing body having an opening for allowing insertion of said component and a seat formed therein encompassing the component from at least opposite sides, said housing body exhibiting on at least one of these sides a deformation zone which is plastically defomed in a direction towards the component in order to clamp the component in place and an elastically deformable lid means for sealing the opening in said housing body, said lid means pressing against the component and urging the component against the seat within the housing body.

8. An assembly according to claim 7, wherein the lid means is firmly joined to the housing body by weld seams.

9. An assembly according to claim 7, wherein the lid means is firmly joined to the housing body by an adhesive bond.

10. An assembly according to claim 7, wherein the housing body has one cavity for the accommodation of unfixed additional components and another cavity for accommodating the component which defines said seat.

* * * * *